US008205547B2

(12) United States Patent
Godecke et al.

(10) Patent No.: US 8,205,547 B2
(45) Date of Patent: Jun. 26, 2012

(54) EMBOSSING APPARATUS, AND METHOD FOR EMBOSSING CARDS

(75) Inventors: Alexander Godecke, Bernhardswald-Pettenreuth (DE); Martin Dimpfl, Lam (DE); Tino Henze, Walderbach (DE); Christian Dobler, Wafferbrunn (DE)

(73) Assignee: Muehlbauer AG, Roding (DE)

( * ) Notice: Subject to any disclaimer, the term of this patent is extended or adjusted under 35 U.S.C. 154(b) by 755 days.

(21) Appl. No.: 12/307,799

(22) PCT Filed: Jul. 6, 2007

(86) PCT No.: PCT/EP2007/056883

§ 371 (c)(1),
(2), (4) Date: Jan. 7, 2009

(87) PCT Pub. No.: WO2008/003777

PCT Pub. Date: Jan. 10, 2008

(65) Prior Publication Data

US 2009/0277346 A1 Nov. 12, 2009

(30) Foreign Application Priority Data

Jul. 7, 2006 (DE) ..... 10 2006 031 387

(51) Int. Cl.

| | |
|---|---|
| ***B41F 19/02*** | (2006.01) |
| ***B31F 1/07*** | (2006.01) |
| ***B44B 5/00*** | (2006.01) |

(52) U.S. Cl. ..... 101/18; 101/16; 101/17

(58) Field of Classification Search ..... 101/16–18, 101/3.1, 19, 28, 32

See application file for complete search history.

(56) References Cited

U.S. PATENT DOCUMENTS

| | | | | |
|---|---|---|---|---|
| 2,207,966 A | | 7/1940 | Billings, Jr. | |
| 3,223,218 A | | 12/1965 | Terzariol | |
| 3,485,335 A | * | 12/1969 | McMahon | 400/134.6 |
| 5,360,969 A | * | 11/1994 | Suzuki | 235/479 |

FOREIGN PATENT DOCUMENTS

| | | |
|---|---|---|
| DE | 8910915.5 | 11/1989 |
| EP | 0142635 | 8/1984 |
| GB | 2047599 | 12/1980 |
| GB | 2155838 | 10/1985 |
| WO | 2004113054 | 12/2004 |

* cited by examiner

*Primary Examiner* — Daniel J Colilla
*Assistant Examiner* — Marissa Ferguson Samreth
(74) *Attorney, Agent, or Firm* — John A. Miller; Miller IP Group, PLC

(57) ABSTRACT

The invention relates to an embossing apparatus for embossing cards, in particular plastic cards, comprising a feed unit for feeding a card into an embossing region, and an embossing device. The embossing device comprises a displaceable, actuatable embossing die which can be positioned above a position that is to be embossed in the embossing region; a plunger unit which has a displaceable plunger for moving forward the actuatable embossing die, and a striking mechanism for applying pressure to the plunger of the plunger unit in order to carry out an embossing on a card in the embossing region by means of the embossing die.

12 Claims, 8 Drawing Sheets

EMBOSSING APPARATUS, AND METHOD FOR EMBOSSING CARDS

PRIORITY CLAIM

This national phase application is based on PCT/EP2007/056883 filed Jul. 6, 2007 which claims priority to German Application Serial No. 10 2006 031 387.9 filed Jul. 7, 2006, contents of which are incorporated herein.

FIELD OF THE INVENTION

The invention relates to an embossing apparatus for embossing and printing cards, in particular plastic cards, such as e.g. chip cards, identification cards and the like.

BACKGROUND

In conventional embossing and printing systems for plastic cards, one or more drums are used which are provided with a plurality of embossing dies. All of the drums are rotated, so that one of the plurality of embossing dies is selected and is positioned above a region that is to be embossed on the card. The selected embossing die is then pressed onto the card so that the embossing is carried out.

Such embossing systems generally have a number of disadvantages. During the embossing of cards, a large amount of vibration is produced since the weight of the drum is relatively high and this leads to vibrations caused by the positioning and rotation of the drum and also the movement thereof in the direction of the card for the embossing process. Furthermore, due to the size of the drum, it is not possible to utilise the entire width of the card, or else undesirable marks appear on the card due to repositioning using suitable grippers. Furthermore, it is not possible to emboss the entire surface region of the card, since a certain edge width must remain unembossed for transporting the cards through the embossing system.

Plate-type embossing apparatuses are also known from the prior art. For instance, DE 33 30 563 A1 discloses a drive apparatus for an embossing apparatus, in which two embossing dies arranged at a resting distance opposite one another are pressed relative to one another with an embossing pressure against an embossing plate held therebetween. Here, the embossing dies are moved forward by a first drive device relative to one another along the displacement travel, and are subjected to an embossing pressure by a second drive device.

WO 2004/113054 A1 discloses an embossing apparatus for embossing characteristic data into plastic products, in particular containers, wherein at least one embossing die with an embossing unit comprising exchangeable characteristic data units is guided in a longitudinally displaceable manner in a frame of the apparatus. In a raised state of the embossing die, it is possible to feed in the products that are to be embossed and to remove the products that have been embossed, and the embossing is carried out in a lowered state.

SUMMARY

The present invention is directed to sorting the RFID tags, which are arranged one behind the other on a common carrier belt after testing, according to their performance features so that they can be provided separately on corresponding dedicated transport belts in each case. This is achieved by the sorting device and by the method according to the independent claims of the present invention.

The present invention is directed to providing an embossing apparatus which avoids the disadvantages of the prior art and which in particular allows operation with no vibration or with reduced vibration and allows a larger surface area to be embossed on the cards.

This is achieved by the embossing apparatus and by the method for embossing cards according to the independent claims of the present invention.

Further advantageous embodiments of the invention are specified in the dependent claims.

According to one aspect of the present invention, there is provided an embossing apparatus for embossing cards, in particular for plastic cards. The embossing apparatus comprises a feed unit for feeding a card into an embossing region, and an embossing device. The embossing device comprises a displaceable, actuatable embossing die which can be positioned above a position that is to be embossed in the embossing region; a plunger unit which has a displaceable plunger for moving forward the actuatable embossing die, and a striking mechanism for applying pressure to the plunger of the plunger unit in order to carry out an embossing on a card in the embossing region by means of the embossing die, wherein an embossing matrix is provided which comprises a plurality of individually actuatable embossing dies, and wherein the embossing matrix is designed to be displaceable in the X and/or Y direction in order to position a selected one of the embossing dies at a position that is to be embossed in the embossing region. Here, the plane of the feed direction is the X direction, and the plane transverse to the feed direction is the Y direction. The two directions define a horizontal plane of the embossing apparatus. Accordingly, the Z direction runs in a vertical plane through the feed direction (X) and transverse direction (Y).

Preferably, an actuator is provided for displacing the embossing matrix essentially transversely to the feed direction in a transverse direction of the card, so that the selected embossing die is positioned on the card with reference to the transverse direction in a manner dependent on the position that is to be embossed.

Furthermore, the feed unit may comprise guide grooves which are oriented parallel to one another and along which the card can be transported in the feed direction. In particular, a transport apparatus may be provided which comprises a toothed belt which defines card compartments in which the cards to be printed are placed, in order to transport said cards by means of a form fit along the feed direction in the guide grooves of the feed unit.

According to a further embodiment of the invention, a printing tape unit may be provided which provides a printing tape between the embossing die and the position that is to be embossed.

Preferably, a striking mechanism is provided which comprises a rotatable cam disc, so that the plunger of the plunger unit is acted upon by a pressure force in a manner dependent on a position of the cam disc. Furthermore, the striking mechanism may have a pivotable striking lever which can be pivoted by a rotational movement of the cam disc so that, in a manner dependent on a position of the cam disc, a section of the striking lever acts on a pressure plate and thus applies a pressure force to the plunger of the plunger unit. In one preferred embodiment, the striking mechanism is arranged in a fixed position, the plunger being able to be displaced in the X and Y direction. In a further preferred embodiment, the striking mechanism is arranged in a displaceable manner, the plunger and the striking mechanism being coupled to one another in the Y direction. In the X direction, the plunger can still be displaced independently of the striking mechanism.

A plurality of feed units may be provided for feeding cards into corresponding embossing regions of each embossing region, wherein the embossing regions are arranged in such a way that they can be approached successively by the embossing matrix. In this case, the feed units may be adapted so that they alternately provide a card that is to be embossed in the respective embossing region.

According to a further embodiment of the invention, a control unit is provided for controlling the adjustment movements of the embossing matrix, the plunger unit, the feed unit and also the application of pressure by the striking mechanism in a manner adapted to one another.

A further embossing device may be provided which is arranged opposite the embossing device with respect to the embossing region and which furthermore comprises a further embossing matrix which comprises individually actuatable embossing dies. The further embossing matrix is designed in a displaceable manner in order to position a selected one of the further embossing dies at the position that is to be embossed in the embossing region. The embossing device furthermore has a further plunger unit which comprises a further displaceable plunger for moving forward a selected one of the actuatable further embossing dies, and also has a further striking mechanism for applying pressure to the further plunger of the further plunger unit, wherein the striking mechanisms, plunger units and embossing matrices are coupled in such a way that they apply an embossing pressure to a position on the card in the embossing region from both sides at the same time.

According to a further aspect of the invention, a method for embossing a card in an embossing region is provided, which comprises the steps of positioning an embossing matrix, which is designed to be displaceable in the X and/or Y direction, above a position that is to be embossed on the card in the embossing region, using a displaceable plunger to move forward the embossing die arranged in a displaceable embossing matrix, and applying pressure to the plunger so that a card in the embossing region is embossed by the embossing die arranged in a displaceable embossing matrix.

BRIEF DESCRIPTION OF THE DRAWING

Preferred embodiments of the invention will be explained in more detail below with reference to the appended drawings, in which.

DETAILED DESCRIPTION OF THE INVENTION

Figure 1:
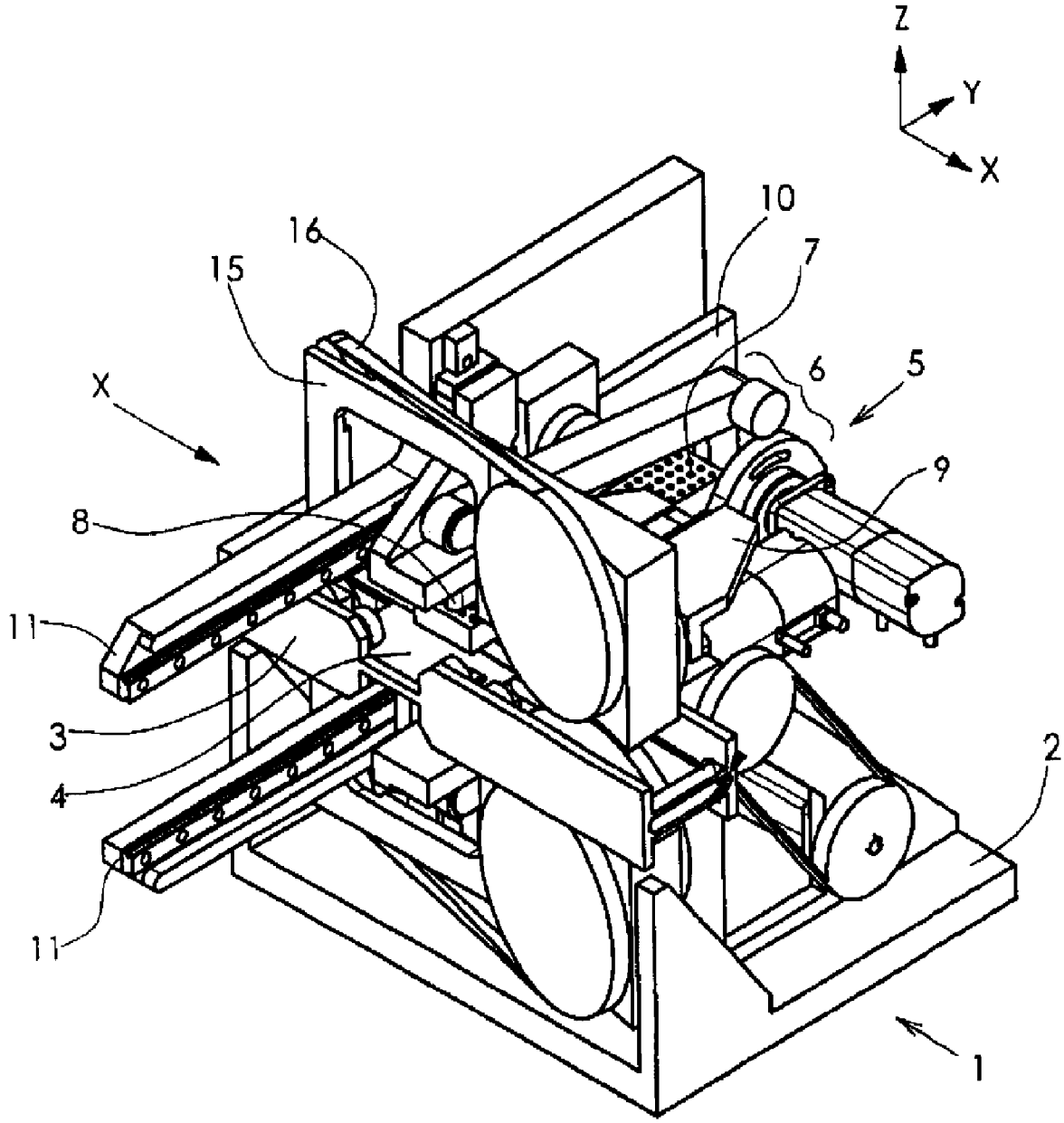
FIGS. 1 and 2 show different perspective views of an embossing apparatus according to one preferred embodiment of the invention.
Figure 2:
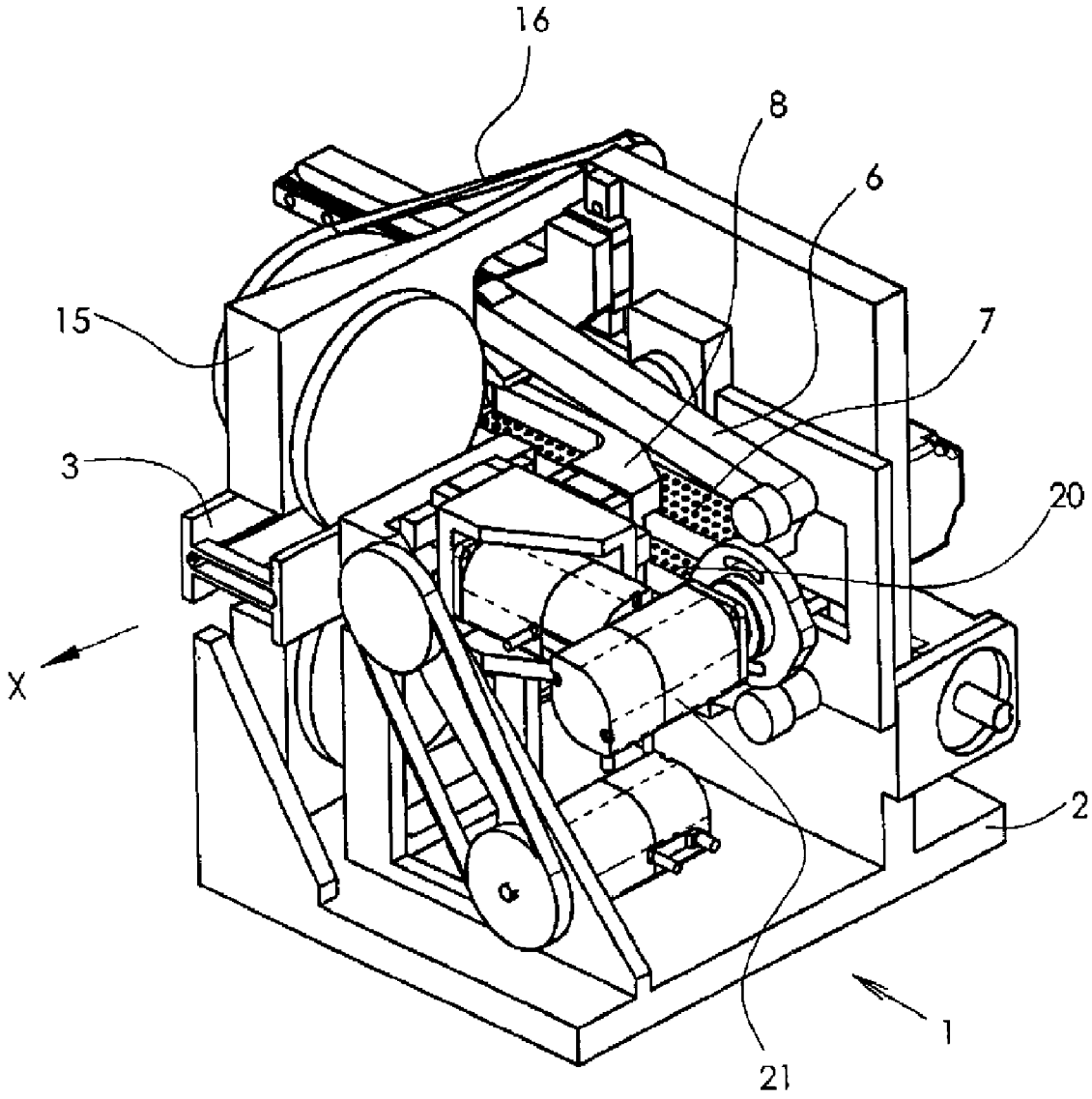

FIGS. 1 and 2 show perspective views of an embossing apparatus 1 according to one preferred embodiment of the invention. The embossing apparatus 1 comprises a housing 2 which carries the mechanical structure. The embossing apparatus 1 serves for embossing plastic cards, such as those used in large numbers for example in the form of chip cards, identification cards and the like.

The embossing apparatus 1 comprises a feed unit 3, via which the cards to be embossed can be moved in a feed direction X into the embossing apparatus 1, where they are printed in an embossing region 4. By means of a further displacement in the feed direction X, the cards are conveyed out of the embossing region 4 of the embossing apparatus 1.

Coupled to the embossing region 4 is an embossing unit 5 which comprises a striking mechanism 6, an embossing matrix 7 and a plunger unit 8. The embossing matrix 7 and the plunger unit 8 are designed in such a way that they move essentially transversely to the feed direction X (preferably at right angles to the feed direction X) over the embossing region 4 by means of a corresponding adjustment unit, in order to position an embossing die 41 (see FIG. 4) of the embossing matrix 7 above the card fed into the embossing region 4. The desired characters can thus be moved forward individually above the desired card position and can correspondingly be embossed. Other movement sequences are also conceivable, wherein the relative movements of the card and embossing matrix 7 displaceable in the X and Y direction differ essentially in terms of their speed. Depending on whether the striking mechanism 6 is designed in a stationary or displaceable manner, the card body can be displaced both in the X direction and in the Y direction.

The embossing matrix 7 is moved by means of a matrix holder 10 along transport rails 11 in the Y direction, i.e. in a transverse direction perpendicular to the feed direction X, over the embossing region 4 so that the embossing die arranged in the embossing matrix is located in the Y direction at the position that is to be printed.

Between the embossing die in the embossing matrix 7 and the card that is to be printed, a printing tape 16 is guided along between the embossing die 41 and the card that is to be printed by means of a first printing tape unit 15, so that the embossing at the same time also produces a printing of the embossing symbol defined by the respective embossing die 41.

In addition to the embossing matrix 7, a further embossing matrix 20 may be provided which is located opposite it with respect to the embossing region 4 and the card arranged therein that is to be printed, said further embossing matrix being coupled in an appropriate manner to the striking mechanism 6 so as also to be able to carry out an embossing and/or printing on an underside of the card that is to be printed in the embossing region 4. Preferably, the further embossing matrix 20 is likewise arranged on the matrix holder 10, so that the embossing matrix 7 and the further embossing matrix 20 are displaced in the Y direction by means of the common matrix holder 10. In this way, the embossing dies arranged in the embossing matrices 7, 20 are arranged at the corresponding selected position that is to be embossed, preferably located opposite one another on both sides of the card that is to be embossed. The characters to be embossed can in this case also be moved forward by means of a displaceable striking mechanism (6).

Figure 3:
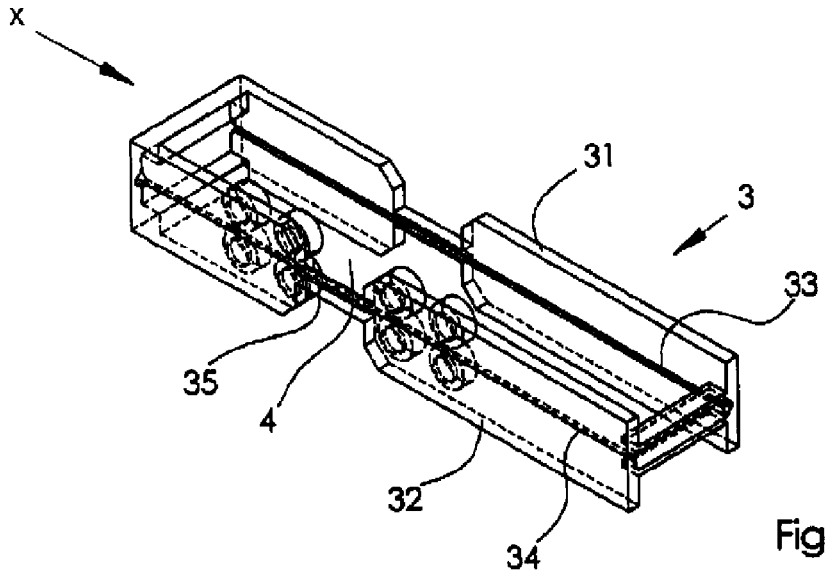
FIG. 3 shows a detailed view of a feed unit of the embossing apparatus of FIGS. 1 and 2.

The feed unit 3 is shown separately in FIG. 3. The feed unit 3 serves for transporting the card that is to be printed through the embossing apparatus 1 in the feed direction X. The feed unit 3 has two guide elements 31, 32 which are arranged parallel to one another and which have a respective guide groove 33, 34 on surfaces located opposite one another, through which guide grooves the card that is to be printed slides when being fed in and conveyed away.

The guide grooves 33, 34 preferably have a depth of 0.5 to 2 mm, in particular 1 mm. The guide elements 31, 32 taper in a receiving region, so that only a narrow web remains in each case, which bears the corresponding guide groove 33, 34. The receiving region serves to make it possible for the embossing matrix 7 to be displaced transversely to the feed direction X into the embossing region 4 and close above the surface of a card located therein.

The card is driven by transport rollers 35 arranged on the guide elements 31, 32, which transport rollers are rotated by a drive unit (not shown) in order to move the card in the feed direction X through the embossing apparatus 1. The transport rollers 35 are preferably designed as rubber rollers and are at least partially spring-mounted so as to be able to compensate height differences during the passage of the card and so as to ensure a certain bearing force which is necessary in order to exert a drive force on the cards. The individual axles of the transport rollers 35 are coupled to one another (not shown) for example via toothed belts or toothed wheels. The drive unit (not shown) for the transport rollers 35 is preferably designed as a servo motor. Besides the task of feeding in and conveying away the card that is to be embossed, the feed unit 3 also has the task of positioning the card in the X direction, while the positioning of the correspondingly selected embossing die 41 at the position that is to be embossed takes place in the Y direction.

Figure 4:
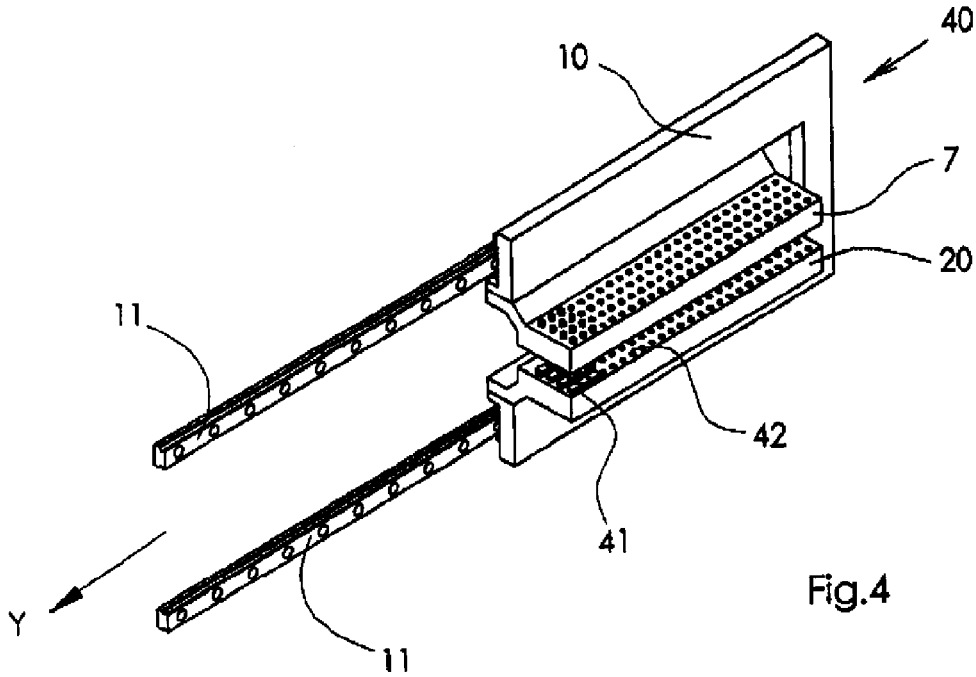
FIG. 4 shows a detailed view of an embossing unit of the embodiment of FIGS. 1 and 2.

FIG. 4 shows an embossing unit 40 which has a U-shaped matrix holder 10, on the legs of which the embossing matrix 7 and the further embossing matrix 20 are arranged. The common matrix holder 10 can be displaced along the transport rails 11 in the Y direction, so that the embossing matrix 7 can be displaced above the embossing region 4 and the further embossing matrix 20 can be displaced below the embossing region 4 and thus they can accommodate between them the card that is to be embossed. The embossing matrices 7, 20 in each case have embossing dies 41 guided in guide holes, the die surfaces of which (surfaces with reliefs and depressions according to the symbols to be embossed) are located opposite one another and which are arranged for example in die rows and die columns. At the opposite end of the die surface of each embossing die 41, there is the plunger surface 42 which can be actuated by the plunger 83 (see FIG. 6) in order to actuate the selected embossing die 41, so that it carries out an embossing of the symbol on the die surface onto the card that is to be embossed. Furthermore, it proves to be time-saving to swap complete matrix sets rather than swapping individual embossing dies or letters in a set of drums. It is also advantageous to use an automatic font detection, for example for matrix sets in different languages.

One of the plurality of embossing dies 41 of the embossing matrices 7, 20 can be selected by a respective movement of the embossing unit 40 in the Y direction, by positioning a die row, in which the selected embossing die 41 is located, in the Y direction at the position on the card that is to be embossed and by selecting and moving toward the X position of the card with the feed unit 3 according to the position that is to be printed in the X direction, so that the selected embossing die 41 is positioned precisely above the position that is to be embossed.

Figure 5:
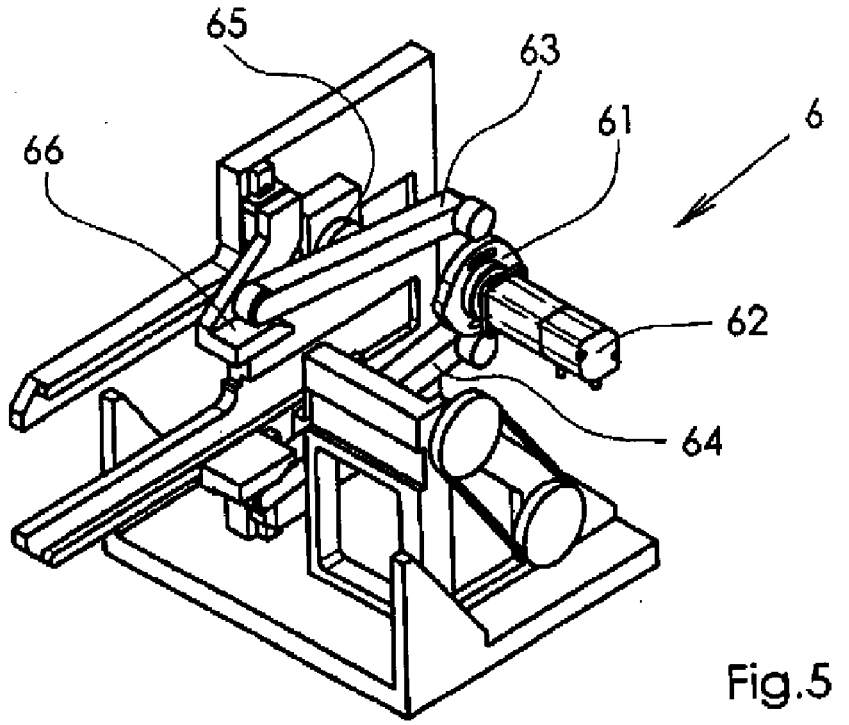
FIG. 5 shows a detailed view of a striking mechanism of the embodiment of FIGS. 1 and 2.

FIG. 5 shows part of the embossing apparatus 1 which shows the striking mechanism 6. The striking mechanism 6 comprises a cam disc 61 which is rotated via a striking mechanism drive 62. The cam disc 61 is coupled to a respective first section of a first striking lever 63 and of a second striking lever 64, so that, when the striking mechanism drive is driven, pivoting movements of the striking levers 63, 64 are carried out. The striking levers 63, 64 are mounted at a respective pivot point 65 so that, when the cam disc 61 rotates, second ends of the striking levers 63, 64 move towards one another and then are moved away from one another again either by the cam disc 61 or e.g. by a spring (not shown). The second ends of the striking levers 63, 64 are coupled to pressure plates 66 which can move in the Z direction perpendicular to the X and Y direction, which pressure plates are moved towards one another according to the movement of the striking levers 63, 64 and then are pushed in opposite directions from one another again by means of a spring arrangement (not shown) when the pressure on the pressure plates 66 by the striking levers 63, 64 is released. The pressure plates 66 in each case have a width which corresponds essentially to the width of the embossing matrix 7 so that, in the event of a displacement of the plunger 83 of the plunger unit 8, the latter can be acted upon by the pressure plates 66 in any state of displacement. Instead of the pivotable striking levers, two coupled cam discs may also be provided which act directly on the pressure plate. The cam discs may in this case be coupled mechanically to one another at one side. The cam discs may also be actuated by separate drives, which are actuated in a synchronised or some other suitable manner by means of the control unit.

Figure 6:
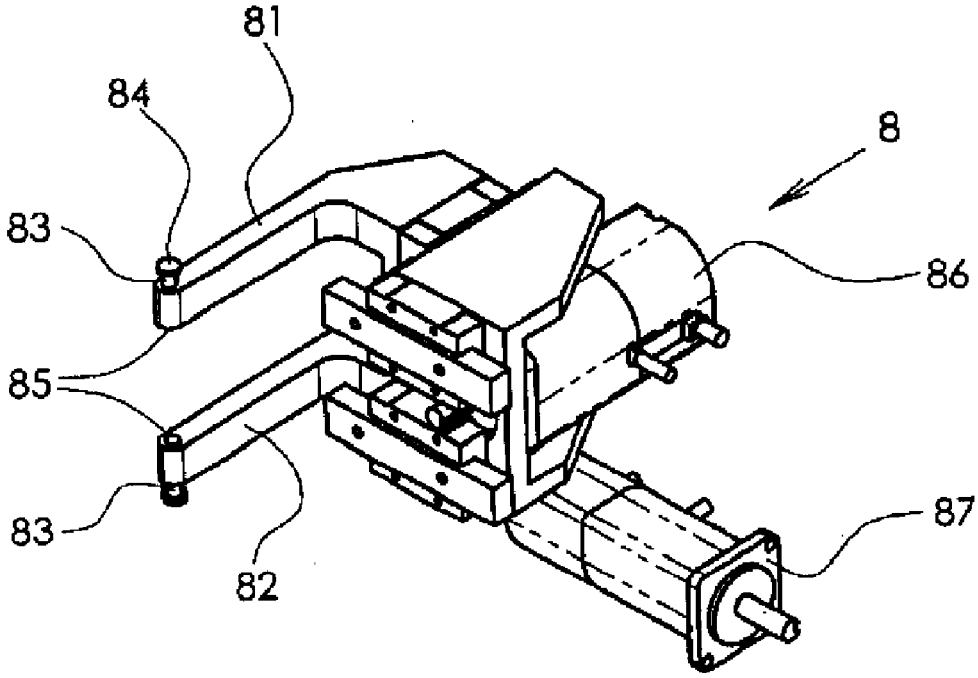
FIG. 6 shows a detailed view of a plunger unit of the embodiment of FIGS. 1 and 2.

FIG. 6 shows the plunger unit 8 in more detail. The plunger unit 8 comprises a first plunger holder 81 and a second plunger holder 82, at the outer end of which the plunger 83 is arranged in each case. The plungers 83 have a pressure surface 84 assigned to the pressure plates 66 of the striking mechanism 6. Arranged opposite the pressure surface 84 is a respective plunger surface 85 which, when a strike or pressure is exerted by the pressure plates 66 of the striking mechanism 6, strikes the plunger surface 42 of the selected embossing die 41 of the embossing unit 40 and thus moves the embossing die in the direction of the card that is to be embossed in the embossing region. In order to detach the plunger 83 from the embossing die 41 again, a spring-elastic bearing of the plunger 83 is provided. This may be provided at the outer end of the respective plunger holder 81, 82 in a guide for the plunger 83, or else the entire plunger holder 81, 82 is mounted in an elastic manner so that, when a force is applied to the respective pressure surface 84 of the plungers 83, the latter are pressed towards one another and then the plungers 83 are moved away from one another again when the force is removed. The plunger holders 81, 82 and the plungers 83 can be displaced in two directions. The plunger holders 81, 82 can be displaced in the Y direction by means of a first adjustment motor 86 and in the X direction by means of a second adjustment motor 87. On the one hand, it is necessary to displace the plunger holders in the Y direction so as to be able to print different positions in the Y direction on the card. Furthermore, the plunger holders 81, 82 are also able to be displaced in the X direction so as to be able to select embossing dies 41 from different die columns of the embossing matrix 7.

The embossing matrix 7 has separately actuatable embossing dies 41 arranged in matrix form, which can be selected and actuated individually by the plunger 83 of the plunger unit 8. This is achieved essentially in that the embossing matrix 7 and the plunger 83 are displaceable relative to one another, so that the embossing matrix 7 is arranged above the embossing region 4 in such a way that the selected embossing die 41 in the embossing matrix 7 is moved toward the position that is to be embossed and then (or at the same time) the selected embossing die 41 is moved forward by the plunger 83 so that, by means of the striking mechanism 6, the plunger 83 is acted upon by an embossing pressure which acts on the embossing die 41 so that the card that is to be printed is embossed. The embossing height or depth of the characters to be embossed can advantageously be determined by the change in travel of the striking mechanism 6 (a change in stroke of the plunger changes the embossing depth).

Figure 7:
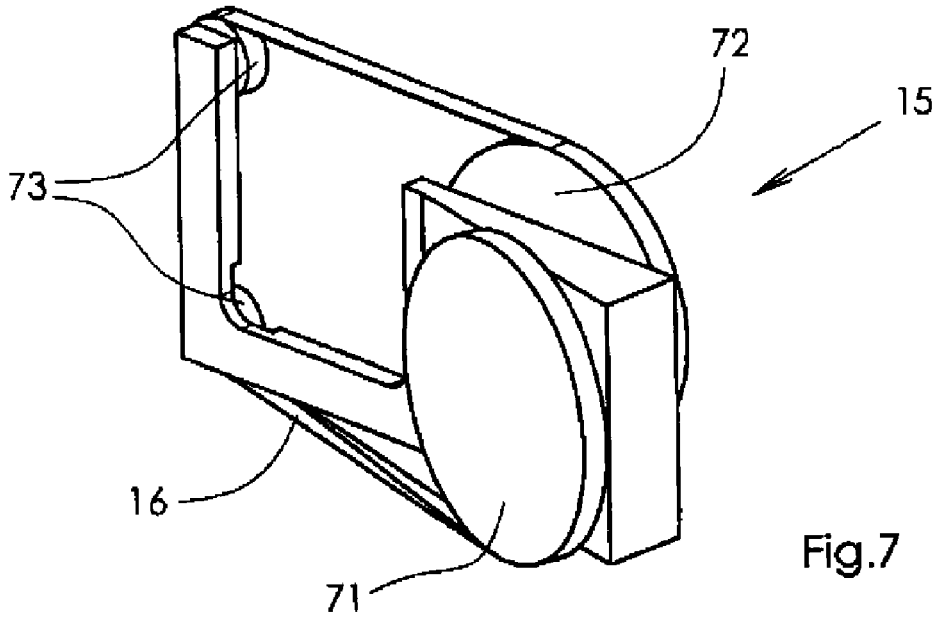
FIG. 7 shows a detailed view of a printing tape unit of the embodiment of FIGS. 1 and 2.

FIG. 7 shows the printing tape unit 15 which provides the printing tape 16 which during the embossing process is arranged between the respective embossing die 41 and the surface of the card that is to be embossed. The printing tape unit 15 has a supply roll 71, from which the printing tape 16 is unwound, and a take-up roll 72, onto which the used printing tape is taken up. For a compact structure of the printing tape unit 15, the printing tape 16 is guided over a plurality of rollers 73.

Figure 8:
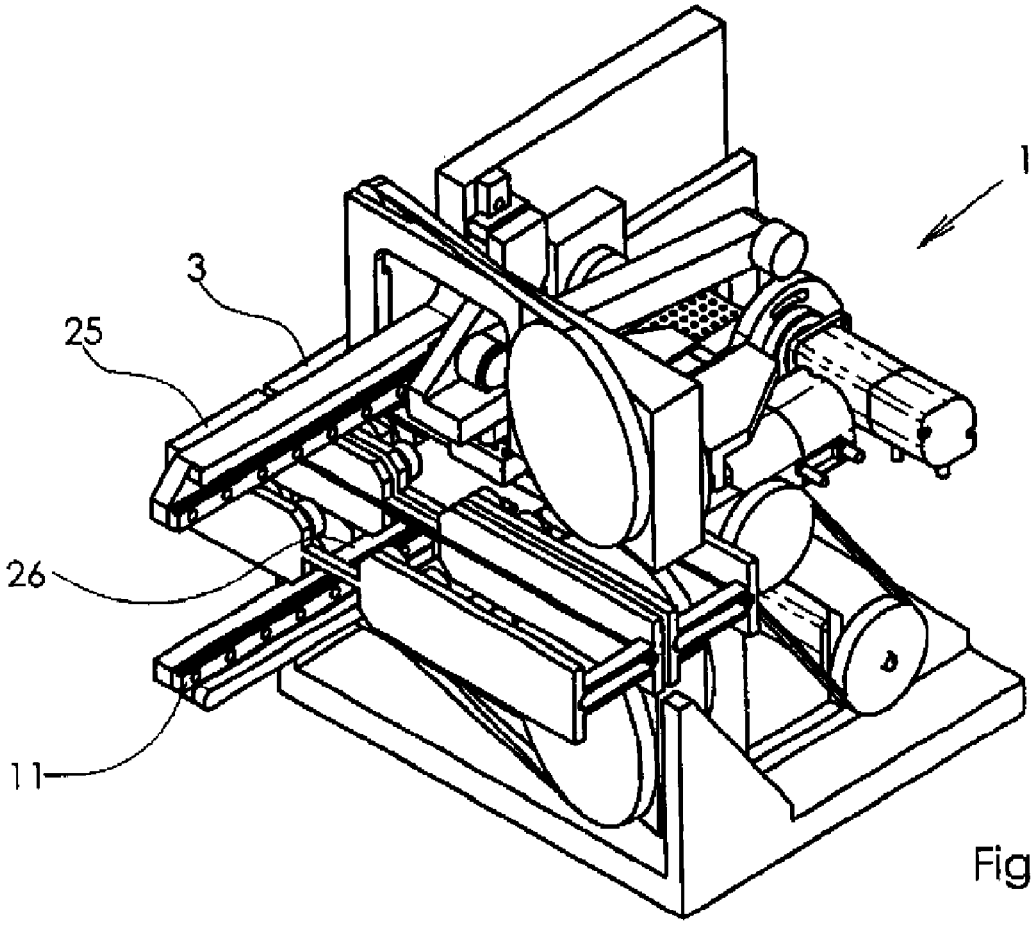
FIG. 8 shows a further embodiment of the embossing apparatus according to the invention with two feed units.

FIG. 8 shows a further embodiment of the embossing apparatus according to the invention, wherein identical elements or elements having the same function are provided with the same references. In addition to the feed unit 3, a further feed unit 25 is also provided which is designed for example in a manner essentially identical to the feed unit 3 and feeds cards to a further embossing region 26. The feed units 3, 25 are preferably arranged parallel to one another. The embossing unit 40 is essentially designed in such a way that, by means of the transport rails 11, the embossing unit 40 can be displaced both over the embossing region 4, to which cards are fed by the feed unit 3, and over the further embossing region 26, to which cards are fed by the further feed unit 25.

Since the embossing usually has to be carried out while the card located in the embossing region is at a standstill, if two feed units 3, 25 are provided the loading of the respective embossing region 4, 26 can take place in an alternating manner, so that the drawing-in and ejection of the cards in the embossing region has no influence or only a relatively small influence on the throughput of the system as a whole. In other words, the embossing unit can be used to print alternately a card in the embossing region 4 and a further card in the further embossing region 26, without there being any waiting times for the embossing unit caused by the conveying-away of the printed card and the feeding-in of the next card that is to be printed. A new card can thus already be fed in while a previous card is still being processed.

Figure 9:
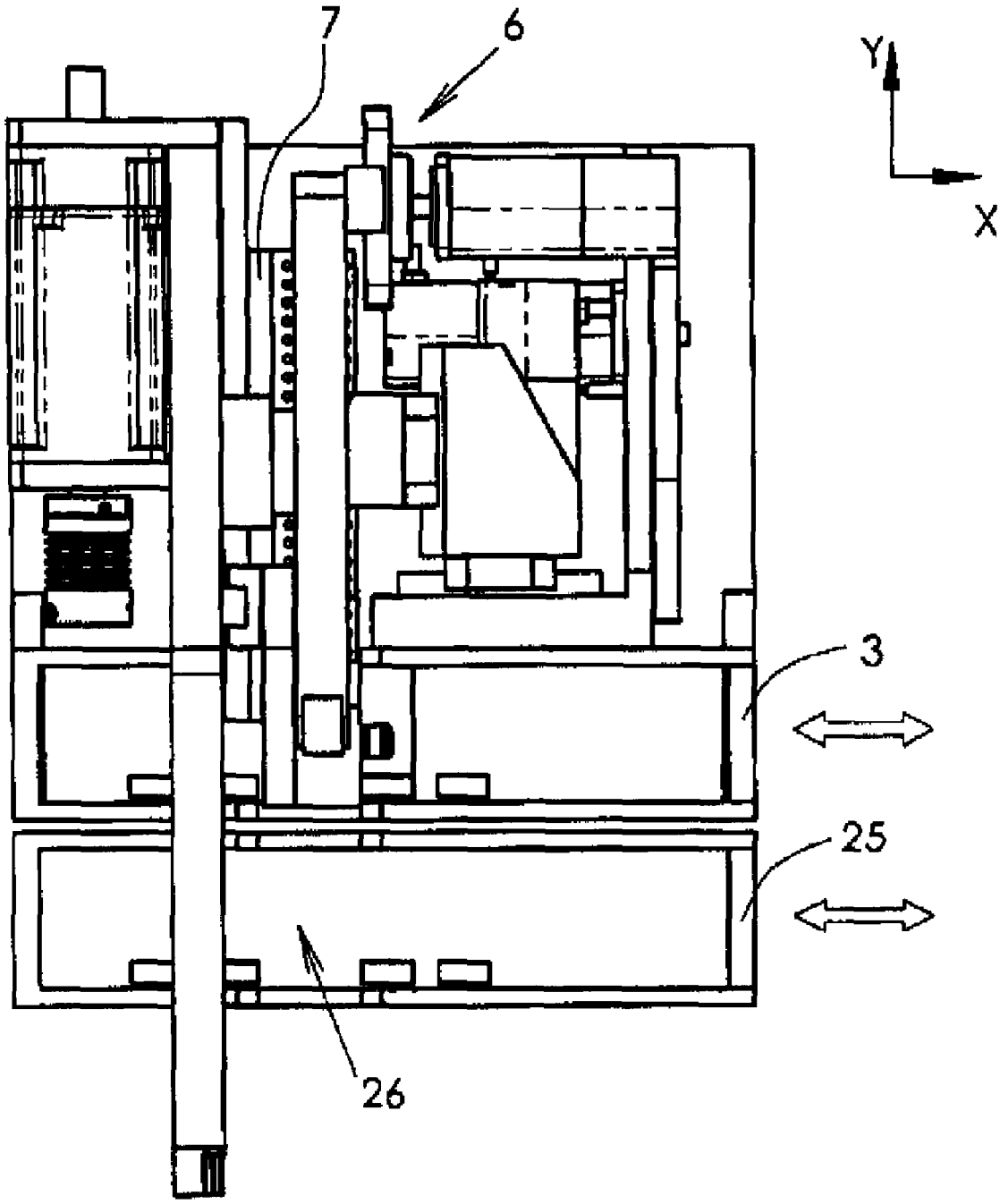
FIG. 9 shows a plan view of the embodiment of FIG. 8.

FIG. 9 shows a plan view of the embodiment of FIG. 8. It is clear that the plunger unit 8 and the embossing unit 40 have to be displaced in the Y direction in order to print both cards in the embossing region 4 and further cards in the further embossing region 26.

Figure 10:
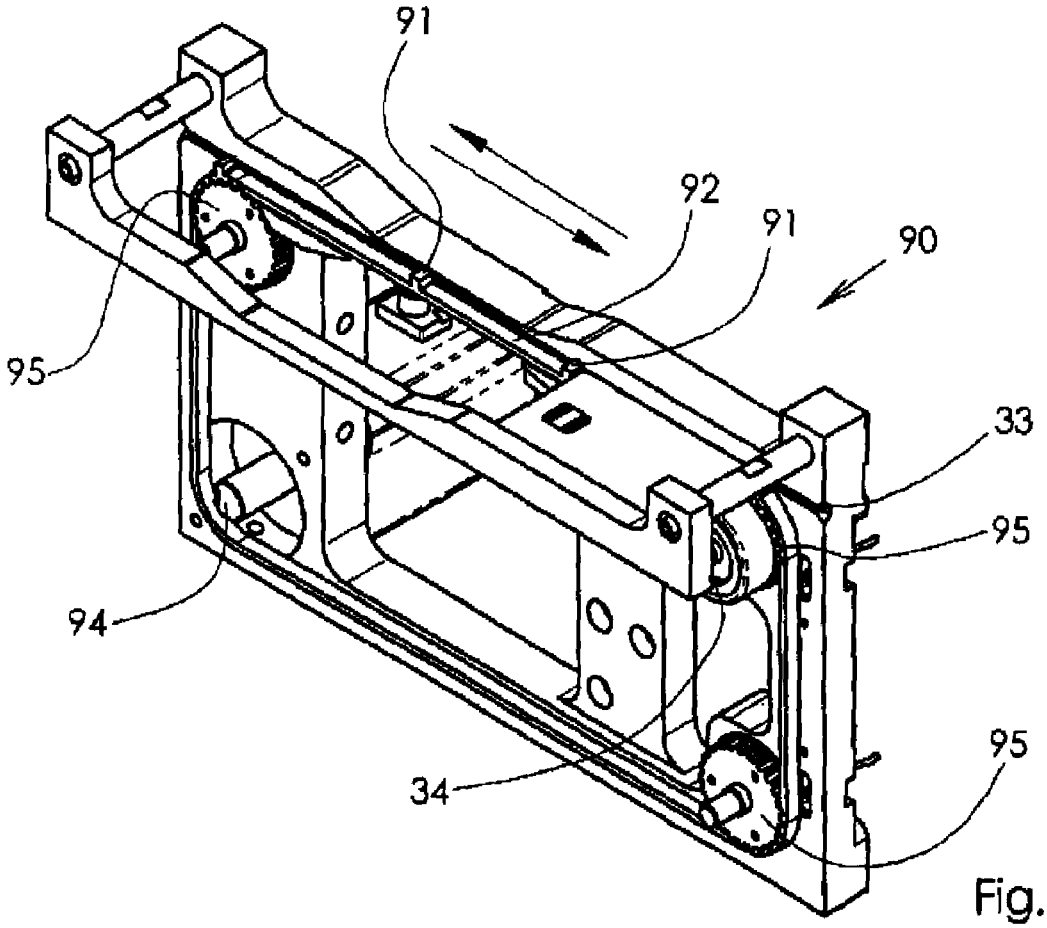
FIGS. 10, 11 and 12 show different views of a further embodiment of a feed unit for the embossing apparatus according to the invention.
Figure 11:
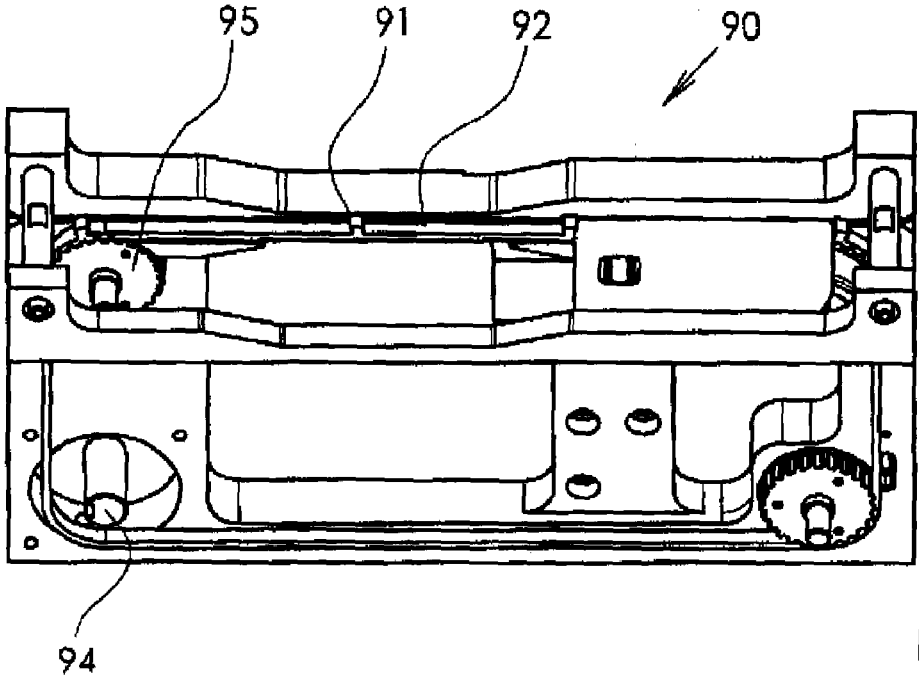
Figure 12:
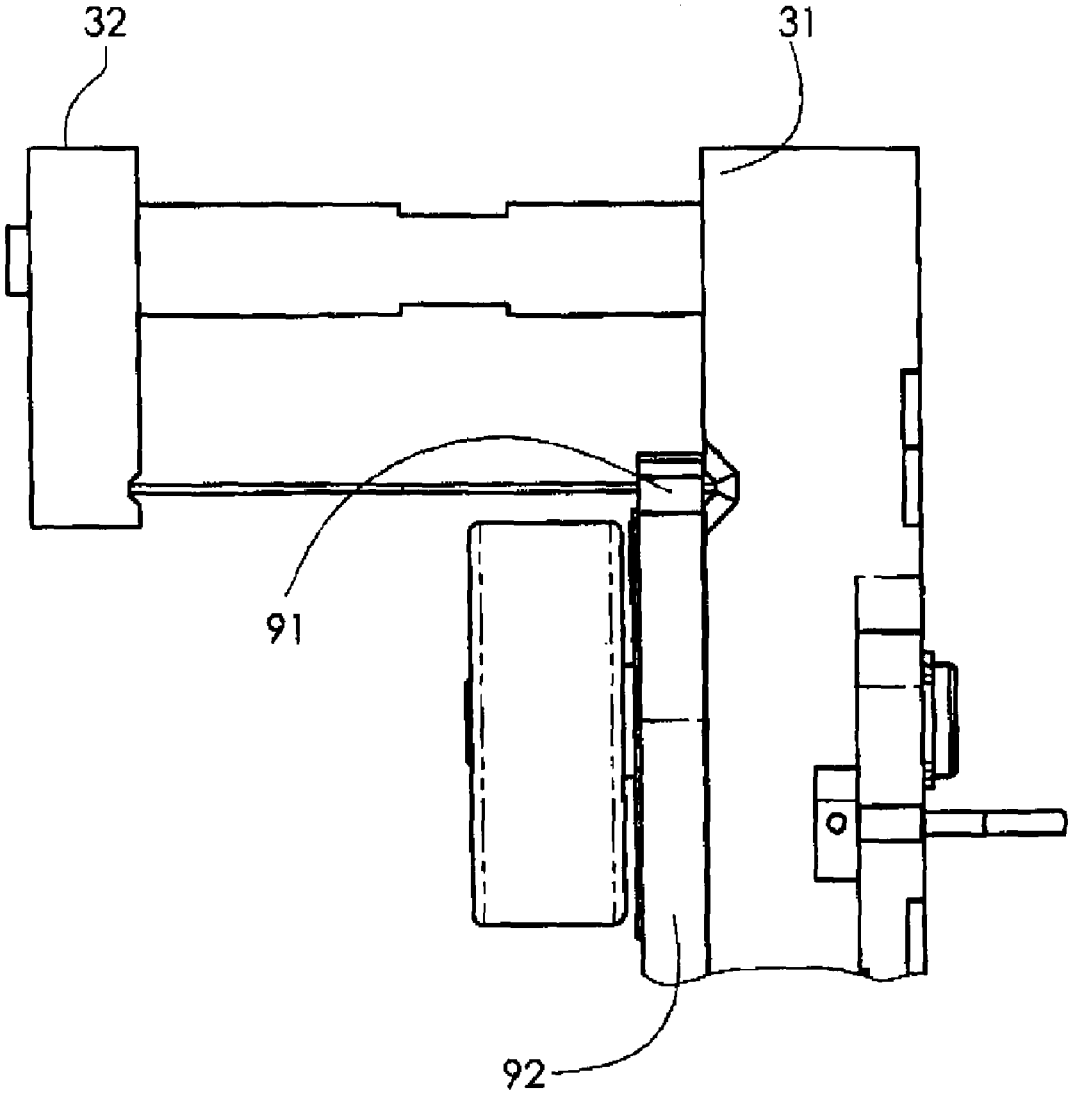

FIGS. 10, 11 and 12 show different views of a further embodiment of the invention with a feed unit 90, in which the transport of the cards through the guide grooves 33, 34 does not take place by means of transport rollers 35 but rather by means of a toothed belt 92. The toothed belt is arranged between the side elements 31, 32 of the feed unit 3 and has carrier teeth 91. The carrier teeth 91 define card compartments in which the cards are placed and which are thus guided in a defined manner through the guide grooves 33, 34 in such a way that the position of the individual cards is known at any point in time. The toothed belt 92 is preferably designed as an endless belt which is driven by a suitable drive device 94, e.g. a stepping motor, via corresponding deflection rollers 95. In this way, the cards can be moved in the feed direction by a form-fitting force transmission, instead of a force transmission by friction as is carried out by the transport rollers 35 in the case of the feed unit shown in FIG. 3. In this embodiment, therefore, no impairment of the positioning accuracy of the cards takes place on account of environmental influences which change the friction value of the rollers.

A control unit (not shown) is provided which coordinates the individual drives and movements according to predefined symbols that are to be embossed. For instance, the drive unit of the feed unit 3, the displacement movement of the embossing matrices 7, 20, the displacement movement of the plunger unit 8 and the actuation of the striking mechanism 6 are actuated according to a sequence of movements which are adapted to one another. When a card is drawn in, this is displaced into the embossing region 4 and is positioned in a manner dependent on the symbol that is to be printed, i.e. on the position of the selected embossing die 41 that is to be used on the embossing matrix 7. The embossing matrix 7 is then displaced in the Y direction above the embossing region 4 in such a way that the selected embossing die 41 is positioned above the position that is to be embossed. At the same time or at around the same time, the plunger unit 8 is actuated so that the plunger is arranged above (in the Z direction) the selected embossing die 41. The actuation of the striking mechanism 6 generally takes place in a cyclical manner and is adapted in such a way that the pressure takes place via the pressure plates 66 on the plunger 83 as soon as the operations of positioning the card, the matrix and the plunger 83 are complete.

The separation of embossing dies 41 and striking mechanism by means of the plunger unit 8 reduces the vibrations during operation of the embossing apparatus.

All of the features disclosed in the application documents are claimed as essential to the invention in so far as they are novel individually or in combination with respect to the prior art.

The embodiments of the invention in which an exclusive property or privilege is claimed are defined as follows:

1. Embossing apparatus for embossing cards, in particular plastic cards, comprising:

- a first embossing device having at least one displaceable, actuatable embossing die which can be positioned above a position that is to be embossed in an embossing region;
- a first plunger unit which has a vertically displaceable plunger which is displaceable in an X and Y direction for moving forward the displaceable actuatable embossing die in a Z direction;
- a first striking mechanism arranged in a fixed position for applying pressure to the vertically displaceable plunger of the first plunger unit in order to carry out an embossing on a card in the embossing region by means of the at least one embossing die;
- a first feed unit for feeding a card into the embossing region in a feed direction; and
- a first embossing matrix having a plurality of individually actuatable embossing dies, wherein the first embossing matrix is designed to be displaceable in the X and/or Y direction independent of the movement of the vertically displaceable plunger in order to position a selected embossing die vertically and/or horizontally at a position that is to be embossed in the embossing region.

2. The embossing apparatus according to claim 1, further comprising an actuator for displacing the first embossing matrix essentially transversely to the feed direction in a transverse direction of the card, so that the selected embossing die is positioned on the card with reference to the transverse direction in a manner dependent on the position that is to be embossed.

3. The embossing apparatus according to claim 2, further comprising a plurality of feed units for feeding cards into corresponding embossing regions of each embossing region, wherein the embossing regions are arranged in such a way that they can be approached successively by the first embossing matrix.

4. The embossing apparatus according to claim 3, where the plurality of feed units are adapted so that they alternately provide a card that is to be embossed in the respective embossing region.

5. The embossing apparatus according to claim 1, wherein the first feed unit has guide grooves which are oriented parallel to one another and along which the card can be transported in the feed direction.

6. The embossing apparatus according to claim 5, further comprising a transport apparatus having a toothed belt which defines card compartments in which the card to be printed is placed, in order to transport said card by means of a form fit along the feed direction in the guide grooves.

7. The embossing apparatus according to claim 1, further comprising a printing tape unit which provides a printing tape between the displaceable actuatable embossing die and the position that is to be embossed.

8. The embossing apparatus according to claim 1, further comprising a cam disc striking mechanism having at least one rotatable cam disc, so that a section of the plunger of the plunger unit is acted upon by a pressure force in a manner dependent on a position of the cam disc.

9. The embossing apparatus according to claim 1, wherein the first striking mechanism is arranged in a displaceable manner, the plunger and the first striking mechanism being coupled to one another in the Y direction.

10. The embossing apparatus according to claim 1, further comprising a control unit for controlling the adjustment movements of the first embossing matrix, the first plunger unit of the first feed unit and also the application of pressure by the first striking mechanism in a manner adapted to one another.

11. The embossing apparatus according to claim 1, further comprising:

a second embossing device which is arranged opposite the first embossing device with respect to the embossing region;

a second embossing matrix having a second set of individually actuatable embossing dies, wherein the second embossing matrix is designed in a displaceable manner in order to position a selected one of the second set of embossing dies at the position that is to be embossed in the embossing region;

a second plunger unit having a vertically displaceable plunger for moving forward a selected one of the second set of individually actuatable embossing dies of the second embossing matrix; and a second striking mechanism for applying pressure to the second plunger unit, wherein the first and second striking mechanisms, plunger units and embossing matrices are coupled in such a way that they apply an embossing pressure to a position on the card in an embossing region from both sides simultaneously.

12. A method for embossing a card in an embossing region comprising:

positioning a displaceable embossing matrix, which is designed to be displaceable in an X and/or Y direction and which has a plurality of individually actuatable embossing dies arranged above a position that is to be embossed on the card in an embossing region;

using a vertically displaceable plunger to move forward an actuatable embossing die arranged in the displaceable embossing matrix in a Z direction; and applying a pressure to the vertically displaceable plunger so that a card in the embossing region is embossed by the embossing die arranged in the displaceable actuatable embossing matrix;

wherein the plunger is displaceable in an X and Y direction, and is movable independently of the displaceable embossing matrix.

* * * * *